US009349313B2

(12) United States Patent
Kawae et al.

(10) Patent No.: US 9,349,313 B2
(45) Date of Patent: May 24, 2016

(54) DISPLAY DEVICE AND DRIVING METHOD THEREOF

(71) Applicant: SAMSUNG DISPLAY CO., LTD., Yongin, Gyeonggi-Do (KR)

(72) Inventors: Daisuke Kawae, Yokohama (JP); Ryo Ishii, Yokohama (JP)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 226 days.

(21) Appl. No.: 14/094,449

(22) Filed: Dec. 2, 2013

(65) Prior Publication Data

US 2014/0152709 A1 Jun. 5, 2014

(30) Foreign Application Priority Data

Dec. 3, 2012 (JP) ..... 2012-264143

(51) Int. Cl.
*G09G 3/32* (2016.01)
*G09G 3/20* (2006.01)

(52) U.S. Cl.
CPC ..... *G09G 3/3225* (2013.01); *G09G 3/2022* (2013.01); *G09G 3/325* (2013.01); *G09G 2300/0819* (2013.01); *G09G 2300/0842* (2013.01); *G09G 2300/0871* (2013.01); *G09G 2300/0876* (2013.01); *G09G 2320/0238* (2013.01); *G09G 2320/045* (2013.01)

(58) Field of Classification Search
CPC ... G09G 3/3225; G09G 3/3291; G09G 3/325; G09G 3/3208; G09G 3/32; G09G 3/30; G09G 3/2022; G09G 3/2018; G09G 3/2014; G09G 3/00; G09G 2300/0852; G09G 2300/0842; G09G 2300/0871; G09G 2300/0876; G09G 2300/0819; G09G 2320/045; G09G 2320/0238
USPC ..... 345/690
See application file for complete search history.

(56) References Cited

U.S. PATENT DOCUMENTS

| | | | | |
|---|---|---|---|---|
| 7,358,937 | B2 * | 4/2008 | Suzuki | G09G 3/3241 345/76 |
| 7,903,052 | B2 * | 3/2011 | Kwak | G09G 3/3233 315/169.1 |
| 8,922,462 | B2 * | 12/2014 | Tomida | G09G 3/3233 345/204 |
| 9,153,158 | B2 * | 10/2015 | Kim | G09G 3/20 |
| 2007/0115225 | A1 * | 5/2007 | Uchino | G09G 3/3233 345/76 |
| 2008/0278464 | A1 * | 11/2008 | Yamamoto | G09G 3/3233 345/204 |
| 2010/0309174 | A1 * | 12/2010 | Tomida | G09G 3/3233 345/204 |
| 2010/0309178 | A1 * | 12/2010 | Tomida | G09G 3/3233 345/205 |

FOREIGN PATENT DOCUMENTS

| | | | |
|---|---|---|---|
| JP | 2003-330416 | A | 11/2003 |
| JP | 2005-257878 | A | 9/2005 |
| JP | 2005-345722 | A * | 12/2005 |
| JP | 2006-030946 | A | 2/2006 |
| JP | 2008-292785 | A | 12/2008 |
| JP | 4197647 | B2 | 12/2008 |
| JP | 2009-223243 | A | 10/2009 |
| JP | 2010-145579 | A | 7/2010 |

* cited by examiner

*Primary Examiner* — Julie Anne Watko
(74) *Attorney, Agent, or Firm* — Lee & Morse, P.C.

(57) ABSTRACT

A display device includes a light emitting diode that emits a light in response to a current supplied thereto, a constant current circuit that includes a first transistor to control an amount of the current supplied to the light emitting diode, and a pixel circuit that includes a switching circuit including a second transistor to switch the supply of the current to the light emitting diode and a capacitor including a first terminal connected to a gate terminal of the second transistor and a second terminal connected to a signal line that changes a voltage of the other terminal. The first transistor and the second transistor are connected between a first power supply line and an anode of the light emitting diode including a cathode connected to a second power supply line in series.

11 Claims, 12 Drawing Sheets

DISPLAY DEVICE AND DRIVING METHOD THEREOF

CROSS-REFERENCE TO RELATED APPLICATION

Japanese Patent Application No. 2012-264143, filed on Dec. 3, 2012, in the Korean Intellectual Property Office, and entitled: "DISPLAY DEVICE AND DRIVING METHOD THEREOF," is incorporated by reference herein in its entirety.

BACKGROUND

1. Field

The present disclosure relates to a display device including a light emitting diode that emits light using current and a driving method of the display device.

2. Description of the Related Art

In recent years, a display device including a light emitting diode that emits light with an intensity of current applied thereto, e.g., organic electroluminescence display device, has been developed. The display device controls an amount of the current applied to the light emitting diode by using a driving transistor in each pixel to control a gray scale of a display image. Therefore, when a variation in characteristic deviation is generated in the driving transistor, the characteristic deviation exerts an influence on the display image.

SUMMARY

Embodiments provide a display device including a light emitting diode that emits a light in response to a current supplied thereto and a pixel circuit connected to the light emitting diode. The pixel circuit include a constant current circuit that includes a first transistor to control an amount of the current supplied to the light emitting diode and a switching circuit including a second transistor to switch the supply of the current to the light emitting diode and a capacitor including one terminal connected to a gate terminal of the second transistor and the other terminal connected to a signal line that changes a voltage of the other terminal. The first transistor and the second transistor are connected between a first power supply line and an anode of the light emitting diode including a cathode connected to a second power supply line in series.

The display device may include a driving circuit that drives the pixel circuit such that the light emitting diode emits the light. The driving circuit controls voltages of the first and second power supply lines to allow the light emitting diode to be in a light non-emission state, controls the signal line to change a voltage of the gate terminal of the second transistor by using a capacitive coupling of the capacitor and to turn on a current path between the anode of the light emitting diode and the first power supply line, turns on a current path between a gate terminal of the first transistor and the anode after turning off the current path between the anode and the first power supply line, turns on a current path between the gate terminal of the first transistor and the first power supply line to set the gate terminal of the first transistor to have a voltage corresponding to the amount of the supplied current, controls the voltage of the signal line, after the setting the voltage of the gate terminal, to return the voltage of the gate terminal of the second transistor to a voltage before the light emitting diode is switched to the light non-emission state by the capacitance coupling of the capacitor, and drives the pixel circuit to switch the light emitting diode to a light emission state.

The switching circuit may include a third transistor connected between a data line and the gate terminal of the second transistor, and the driving circuit is driven to turn the third transistor off during a period in which at least the voltage of the gate terminal of the second transistor is changed by the capacitance coupling.

The pixel circuit may be a plurality of pixel circuits and the driving circuit may substantially simultaneously perform the driving on the pixel circuits.

The constant current may be set with respect to all pixels by the constant current circuit.

The driving of the driving circuit may be performed more than once during one frame period.

Embodiments provide a driving method of a pixel circuit driving a light emitting diode that emits a light in response to a current supplied thereto, the pixel circuit including a constant current circuit that includes a first transistor to control an amount of the current supplied to the light emitting diode, and a switching circuit including a second transistor to switch the supply of the current to the light emitting diode and a capacitor connected to a gate terminal of the second transistor, the first and second transistors being connected between a first power supply line and an anode of the light emitting diode including a cathode connected to a second power supply line in series, including controlling voltages of the first and second power supply lines to allow the light emitting diode to be in a light non-emission state, changing a voltage of the gate terminal of the second transistor by using a capacitive coupling of the capacitor and to turn on a current path between the anode of the light emitting diode and the first power supply line, turning on a current path between a gate terminal of the first transistor and the anode after turning off the current path between the anode and the first power supply line, turning on a current path between the gate terminal of the first transistor and the first power supply line to set the gate terminal of the first transistor to have a voltage corresponding to the amount of the supplied current, returning the voltage of the gate terminal of the second transistor to a voltage before the light emitting diode is switched to the light non-emission state by the capacitance coupling of the capacitor after the setting the voltage of the gate terminal, and driving the pixel circuit to switch the light emitting diode to a light emission state.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
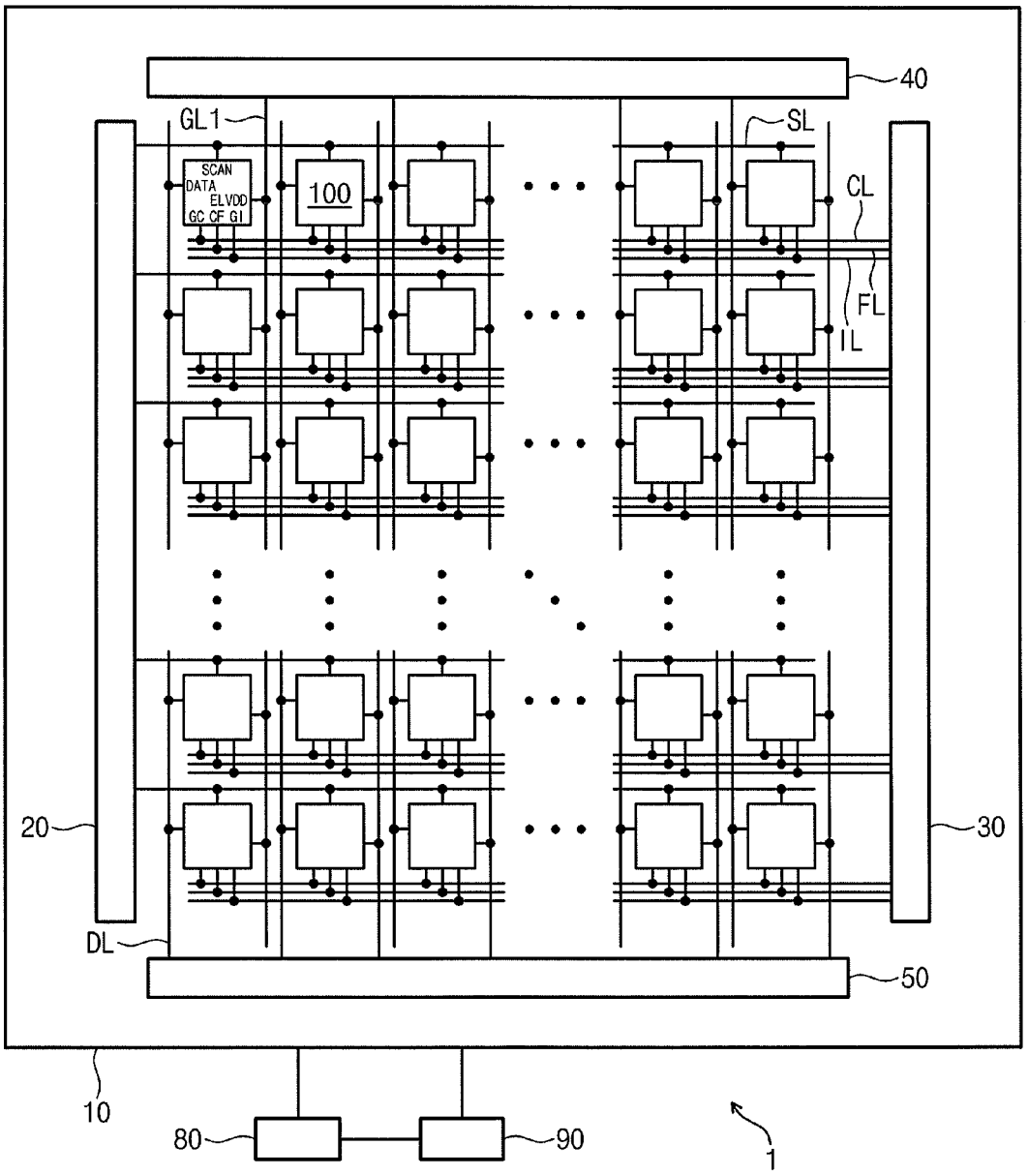
FIG. 1 illustrates an electronic device according to a first exemplary embodiment of the present disclosure.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

The terminology used herein is for the purpose of describing particular embodiments only and is not intended to be limiting of the disclosure. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 illustrates an electronic device 1 according to a first exemplary embodiment of the present disclosure. The electronic device 1 may be a device that includes a display part to display an image, such as a smart phone, a mobile phone, a personal computer, a television set, etc. The electronic device 1 includes a display device 10, a controller 80, and a power supply 90. The display device 10 includes a plurality of pixel circuits 100 arranged in a matrix form. The display device 10 controls a light emitting diode connected to each pixel circuit 100 such that the light emitting diode emits a light, thereby displaying the image. Each of the pixel circuits 100 is connected to the light emitting diode EL (refer to FIG. 3). In the present exemplary embodiment, the light emitting diode EL is an organic light emitting diode (OLED), but it should not be limited to the OLED as long as the light emitting device has a rectifying function. The light emitting diode EL includes a capacitor C2.

In addition, the pixel circuits 100 are arranged in the matrix form, but they should not be limited thereto or thereby. Hereinafter, the pixel circuits 100 are arranged in a matrix form of n rows by m columns. Further, the pixel circuits 100 are connected to light emitting diodes EL having different colors in every column. For instance, red R, green G, and blue B colors are sequentially and repeatedly disposed from the first column. The detailed description about the display device 10 will be described later.

The controller 80 includes a central processing unit (CPU) and a memory to control an operation of the display device 10. The controller 80 controls a scan line driving circuit 20, a constant current set circuit 30, a power supply line driving circuit 40, and a data line driving circuit 50. In addition, the controller 80 receives image data that provides the image displayed in the display part of the electronic device 1, determines a gray scale in each pixel circuit 100 on the basis of the received image data, and applies data voltages according to the determined gray scale to the pixel circuits 100, to thereby control the light emitting diode EL connected to each pixel circuit 100 to emit the light.

The power supply 90 supplies an electric power to each component of the electronic device 1, e.g., the display device 10, the controller 80, etc. In the display device 10, a current is applied to the light emitting diode EL connected to each pixel circuit 100 through a power supply line GL 1 (first power supply line) and a power supply line GL2 (second power supply line), which are connected to the power supply 90.

The display device 10 includes the pixel circuits 100, the scan line driving circuit 20, the constant current set circuit 30, the power supply line driving circuit 40, and the data line driving circuit 50. In addition, the scan line driving circuit 20, the constant current set circuit 30, the power supply line driving circuit 40, and the data line driving circuit 50 serve as driving circuits to drive the pixel circuits 100.

The scan line driving circuit 20 applies a scan signal SCAN to a scan line SL (third signal line) disposed to correspond to the pixel circuits 100 of each row. The scan line driving circuit 20 selects a row in which the pixel circuits 100 that write the data voltage in response to the scan signal SCAN are arranged. In the present exemplary embodiment, the scan line driving circuit 20 sequentially and exclusively selects the first row to the m-th row for each frame. The scan line driving circuit 20 applies the scan signal SCAN having a level of common voltage to the pixel circuits 100 arranged in all rows during a constant current set period.

The constant current set circuit 30 applies a control signal GC to a signal line CL disposed to correspond to the pixel circuits 100 of each row. In addition, the constant current set circuit 30 applies a control signal GI to a signal line IL disposed to correspond to the pixel circuits 100 of each row. Further, the constant current set circuit 30 applies a control signal CF to a signal line FL disposed to correspond to the pixel circuits 100 of each row. The control signal GC, the control signal GI, and the control signal CF may be used to drive the pixel circuits 100 during the constant current set period and may have a constant voltage level during a period rather than the constant current set period. Here, during the constant current set period, the constant current set circuit 30 applies the control signal GC, the control signal GI, and the control signal CF, each having the level of common voltage, to the pixel circuits 100 arranged in all rows.

The data line driving circuit 50 applies a data signal DATA to a data line DL disposed to correspond to the pixel circuits 100 of each column. The data signal DATA is used to determine a period during which the light emitting diode EL connected to each pixel circuit 100 emits the light. In addition, the data signal DATA includes a data voltage that allows the light emitting diode EL to emit light and a data voltage that prevents the light emitting diode EL from emitting light, which are switched to each other in accordance with the image data input to the controller 80. The data line driving circuit 50 applies the data signal DATA having the level of common voltage to the pixel circuits 100 arranged in all rows during the constant current set period.

The power supply line driving circuit 40 applies a power supply signal ELVDD to a power supply line GL1 disposed to correspond to the pixel circuits 100 of each column. The power supply signal ELVDD is a signal supplying the current used when the light emitting diode EL connected to each pixel circuit 100 emits the light. The power supply signal ELVDD may be converted to a positive (+) voltage VHd of the current supply, a negative (−) voltage VLd of the current supply, and a constant current set voltage Von in the constant current set period. In the present exemplary embodiment, the constant current set voltage Von is set to different values for every light emitting colors R, G, and B of the light emitting diode.

In detail, the pixel circuit 100 corresponding to the red color receives the constant current set voltage Von(R), the pixel circuit 100 corresponding to the green color receives the constant current set voltage Von(G), and the pixel circuit 100 corresponding to the blue color receives the constant current set voltage Von(B). The constant current set voltage according to the light emitting color of the light emitting diode is determined depending on a light emitting characteristic of the light emitting diode and a display set of the image, e.g., a color temperature. In addition, the power supply signal ELVDD is fixed to the voltage VHd during the period except for the constant current set period. Further, when the color of the light emitting diode is monochrome, a common constant current set voltage Von is preferred.

Figure 3:
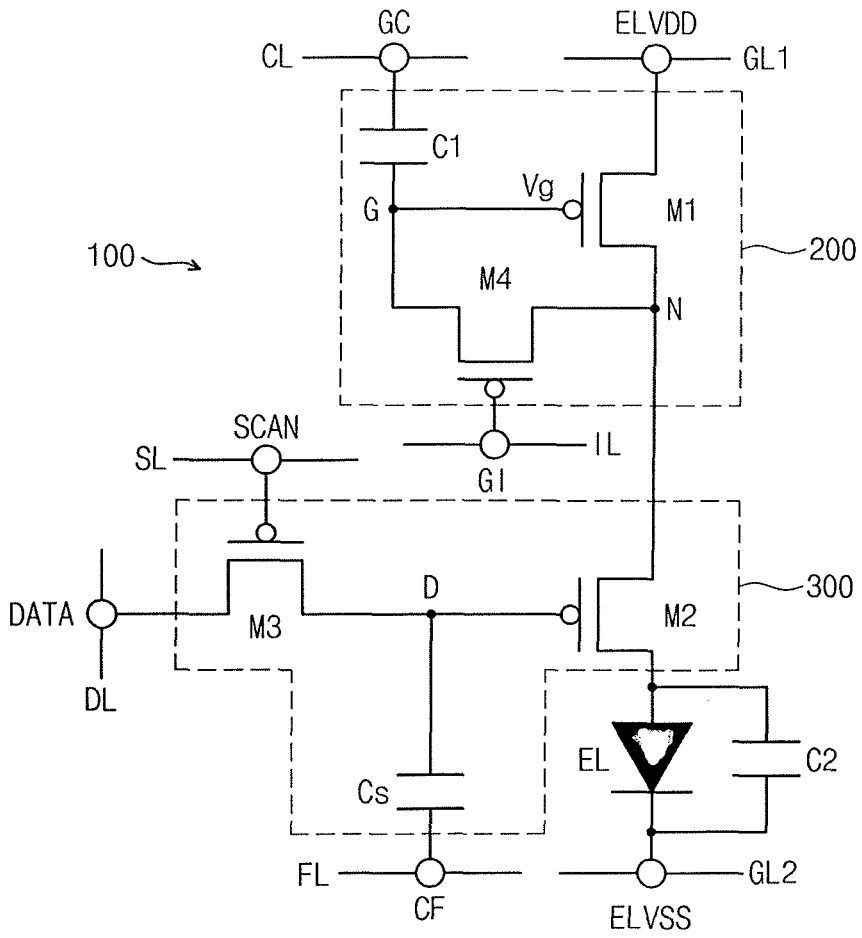
FIG. 3 illustrates a circuit diagram of a pixel circuit according to the first exemplary embodiment of the present disclosure.

In addition, the power supply line driving circuit 40 applies a power supply signal ELVSS to the power supply line GL2 (refer to FIG. 3). The power supply signal ELVSS may be converted to a positive (+) voltage VHs of the current supply, a negative (−) voltage VLs of the current supply during the constant current set period, and the power supply signal ELVSS is fixed to the voltage VLs during the period except for the constant current set period.

Figure 2:
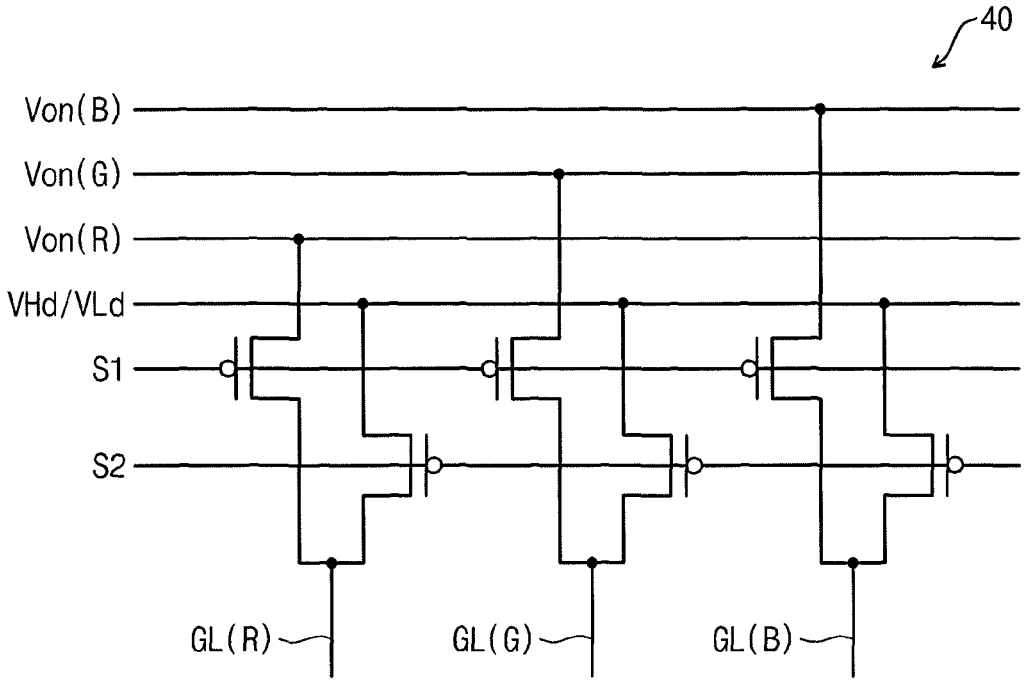
FIG. 2 illustrates a circuit diagram of a power supply line driving circuit according to the first exemplary embodiment of the present disclosure.

FIG. 2 is a circuit diagram showing the power supply line driving circuit 40 according to the first exemplary embodiment of the present disclosure. The power supply line driving circuit 40 includes p-type thin film transistors as shown in FIG. 2. Hereinafter, the term of "transistor" used herein means the p-type thin film transistor.

The power supply line GL(R) applies the power supply signal ELVDD to the pixel circuits 100 arranged in the column corresponding to the R. The power supply line GL(G) applies the power supply signal ELVDD to the pixel circuits 100 arranged in the column corresponding to the G. The power supply line GL(B) applies the power supply signal ELVDD to the pixel circuits 100 arranged in the column corresponding to the B. When the transistor connected to a signal line S1 is turned on (ON-state), the transistor connected to a signal line S2 is turned off (OFF-state). When the transistor connected to the signal line S2 is turned on, the transistor connected to the signal line S1 is turned off. Voltages applied to the signal lines S1 and S2 are controlled by the controller 80.

When only the transistor connected to the signal line S2 is turned on, the power supply signal ELVDD applied to each of the power supply lines GL(R), GL(G), and GL(B) has either the voltage VHd or the voltage VLd by the control of the controller 80.

When the transistor connected to the signal line S1 is turned on, the power supply voltage ELVDD applied to the power supply line GL(R) has the constant current set voltage Von(R), the power supply voltage ELVDD applied to the power supply line GL(G) has the constant current set voltage Von(G), and the power supply voltage ELVDD applied to the power supply line GL(B) has the constant current set voltage Von(B).

FIG. 3 is a circuit diagram showing the pixel circuit 100 according to the first exemplary embodiment of the present disclosure. The pixel circuit 100 may include a constant current circuit 200 and a switching circuit 300 that are connected to the light emitting diode EL with the capacitor C2. The light emitting diode EL includes a cathode connected to the power supply line GL2 and applied with the power supply signal ELVSS. The constant current circuit 200 and the switching circuit 300 are connected between an anode of the light emitting diode EL and the power supply line GL1 in series. In the present exemplary embodiment, the switching circuit 300 is connected between the constant current circuit 200 and the anode of the light emitting diode EL.

The constant current circuit 200 may include two transistors M1 and M4 and a capacitor C1. The capacitor C1 has substantially the same capacitance, e.g., one-tenth to ten times, as that of the capacitor C2. The switching circuit 300 may include two transistors M2 and M3 and a capacitor Cs. As described above, the pixel circuit 100 includes four transistors M1, M2, M3, and M4.

The transistor M1 (first transistor) serves as a constant current source to control the current amount flowing therethrough in response to a voltage applied to a gate terminal thereof. The transistor M1 includes a source and drain terminal, a first one thereof being connected to the power supply line GL 1 to receive the power supply signal ELVDD and a second one thereof being connected to first one of a source and drain terminal of the transistor M2. The connection portion between the transistors M1 and M2 is referred to as a node N.

A first electrode of the capacitor C1 is connected to the signal line CL to receive the control signal GC and a second electrode of the capacitor C1 is connected to the gate terminal of the transistor M1. The connection portion between the capacitor C1 and the gate terminal of the transistor M1 is referred to as a node G and a voltage applied to the node G is referred to as a gate voltage Vg. The capacitor C1 maintains the gate voltage Vg.

The transistor M4 turns the nodes G and N on or off to control the gate voltage Vg. A first one of the source and drain terminal of the transistor M4 is connected to the node N and a second one of the source and drain terminal of the transistor M4 is connected to the node G. A gate terminal of the transistor M4 is connected to the signal line IL to receive the control signal GI.

The transistor M2 (second transistor) controls the supply of the current to the light emitting diode EL in accordance with the voltage applied to a gate terminal thereof. A first one of a source and drain terminal of the transistor M2 is connected to the node N and a second one of the source and drain terminal of the transistor M2 is connected to the anode of the light emitting diode EL. The gate terminal of the transistor M2 is connected to a first one of a source and drain terminal of the transistor M3 (third transistor). The connection portion between the gate terminal of the transistor M2 and the transistor M3 is referred to as a node D.

The transistor M3 controls a timing at the pixel circuit 100 receives the data signal DATA from the data line DL. The first one of a source and drain terminal of the transistor M3 is connected to the node D and a second one of the source and drain terminal of the transistor M3 is connected to the data line DL. Thus, the data signal DATA is input to the other end of the source and drain terminal of the transistor M3 from the data line DL. A gate terminal of the transistor M3 is connected to the scan line SL to receive the scan signal SCAN. The capacitor Cs serves as an auxiliary capacitor to main the data voltage at the node D. A first electrode of the capacitor Cs is connected to the node D and a second electrode of the capacitor Cs is connected to the signal line FL to receive the control signal CF.

Figure 4:
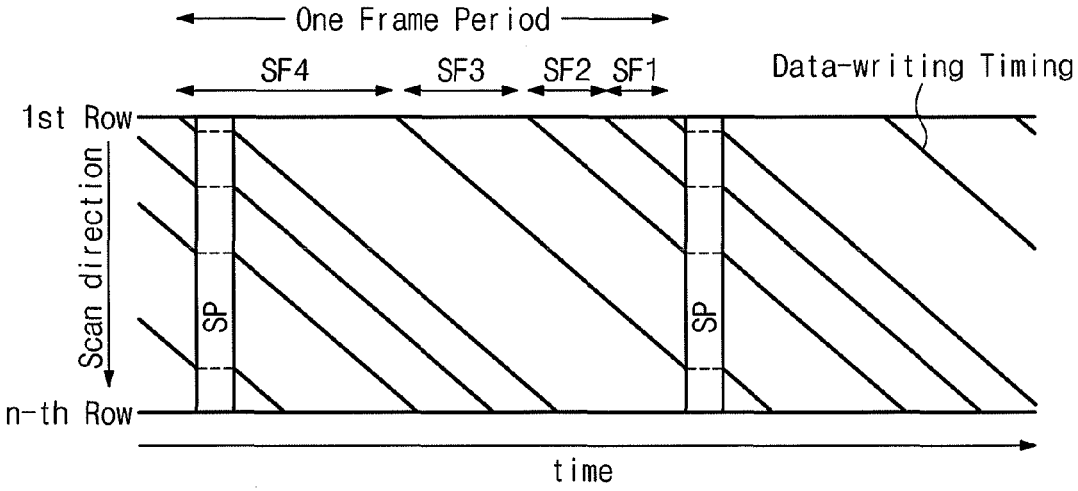
FIG. 4 illustrates a driving timing of the pixel circuit in each row during one frame period according to the first exemplary embodiment of the present disclosure.

FIG. 4 is a view showing a driving timing of the pixel circuit 100 in each row during one frame period according to the first exemplary embodiment of the present disclosure. The one frame period includes the constant current set period SP and a plurality of sub-frame periods. In the present exemplary embodiment, the sub-frame periods include four sub-frame periods SF1, SF2, SF3, and SF4 having different lengths from each other. The light emission and non-emission of the light emitting diode EL are controlled depending on the sub-frame periods SF1, SF2, SF3, and SF4. Hereinafter, the light emission control will be referred to as a pulse width modulation (PWM) light emission control. The number of the sub-frame periods should not be limited to four. In addition, each of the sub-frame periods has a length to which a weighted value of a digital binary code is given, but it should not be limited thereto or thereby.

The data write timing indicated by a diagonal line as shown in FIG. 4 represents the rows of the pixel circuits 100, which are sequentially selected from the first row to the n-th row by the scan signal SCAN, in time series. In the data write timing, the pixel circuits 100 in each row receive the data voltage from the data line DL of each column through the node D to switch the light emitting diode EL to the light emission state or the light non-emission state. In addition, FIG. 4 shows the sub-frame write by an interlaced scanning drive scheme, but the sub-frame write is not limited thereto or thereby.

During the constant current set period SP, the light emitting diode EL is set to the light non-emission state. The constant current set period SP corresponds to a portion of the one frame period. As shown in FIG. 4, the constant current set period SP is uniform in every pixel circuit 100. While the constant current set period SP appears once in the one frame period as shown in FIG. 4, the number of the constant current set period SP is not limited there to or thereby. For instance, the constant current set period SP may appear three times during two frame periods or the constant current set period SP may not appear during each one frame period, e.g., the constant current set period SP may appear twice during three frame periods.

Figure 5:
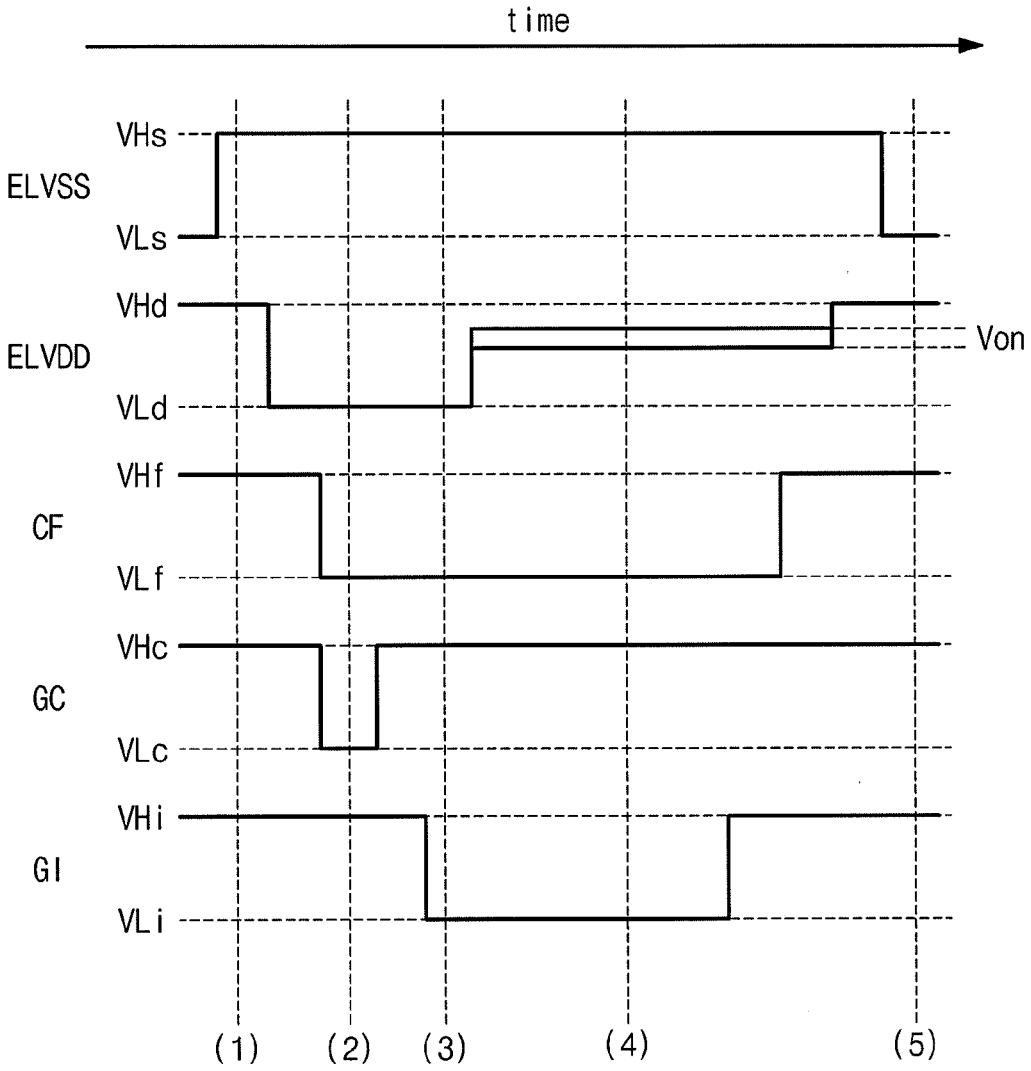
FIG. 5 illustrates a timing chart of a timing of each signal in a constant current set period according to the first exemplary embodiment of the present disclosure.

FIG. 5 is a timing chart showing a timing of each signal in the constant current set period SP according to the first exemplary embodiment of the present disclosure. Each signal (the power supply signals ELVSS and ELVDD and the control signals CF, GC, and GI) is switched to a high level voltage, e.g., VHs, VHd, VHf, VHc, and VHi, and a low level voltage, e.g., VLs, VLd, VLf, VLc, and VLi, when input to the pixel circuits 100. Here, a width exists for the constant current set voltage Von since a difference exists between Von(R), Von (G), and Von(B). Hereinafter, the constant current set voltage will be explained as "Von" unless the difference between Von(R), Von(G), and Von(B) is specifically explained. In addition, the high level voltage and the low level voltage of each signal may be different from those of the other signals, but may be in the range in which the following operation is realized In addition, when the timing chart shown in FIG. 5 is in the range in which the following operation is realized, the timing at which the voltage level of each signal is switched is not limited to the timing shown in FIG. 5. For instance, although the timing at which the voltage level of the signal is changed is shown the same as the timing at which the voltage level of another signal, they may not be subject to the same timing. Further, although the timing at which the voltage level of the signal is changed is shown slower than the timing at which the voltage level of another signal, the timings thereof may be reversed.

The scan signal SCAN (not shown in FIG. 5) may have the high level voltage to turn off the transistor M3. In addition, the data signal DATA does not need a specific voltage. For instance, the data signal DATA may have a voltage in accordance with the data written in the pixel initially selected by the scan signal SCAN after the constant current set period SP is finished.

The operation of the pixel circuit 100 will be described with reference to FIGS. 6 to 10 in order of timing points 1 to 5 shown in FIG. 5.

Figure 6:
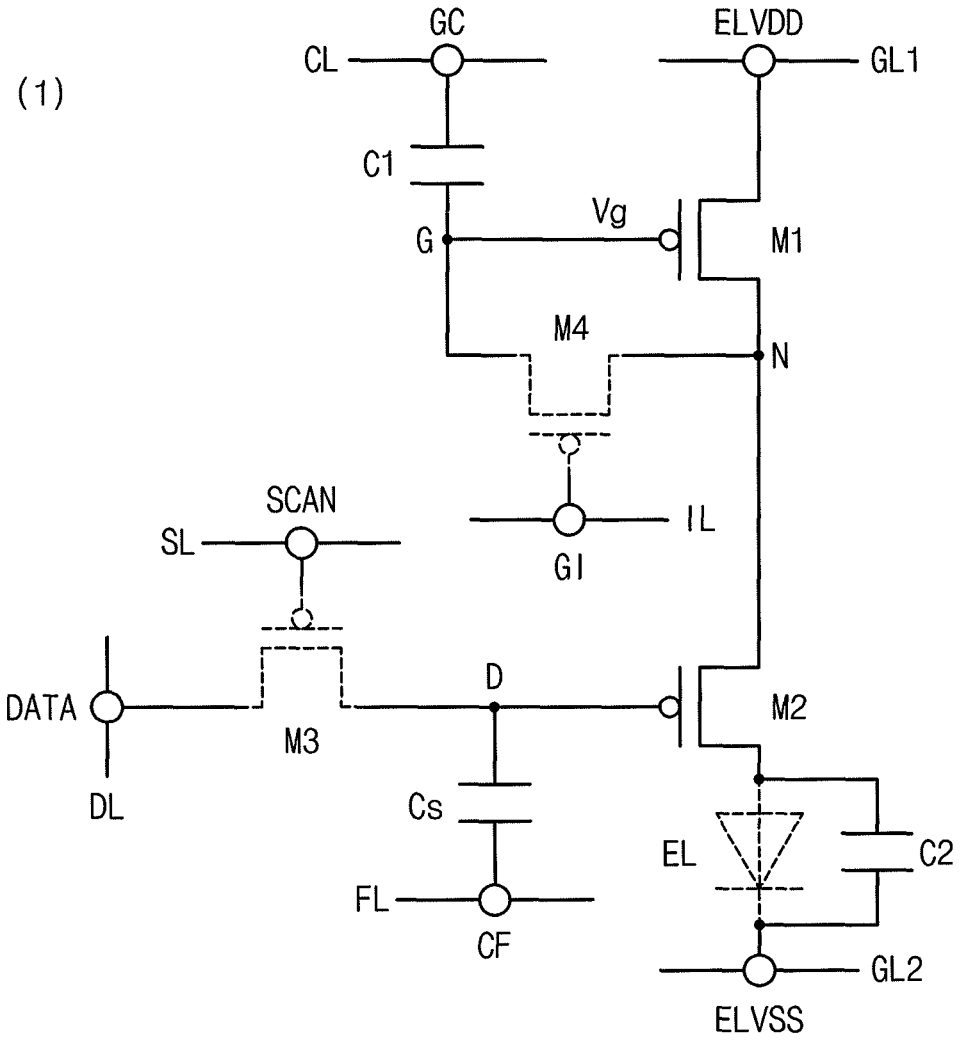
FIG. 6 illustrates a circuit diagram showing a driving state of the pixel circuit at a first timing point according to the first exemplary embodiment of the present disclosure.
Figure 7:
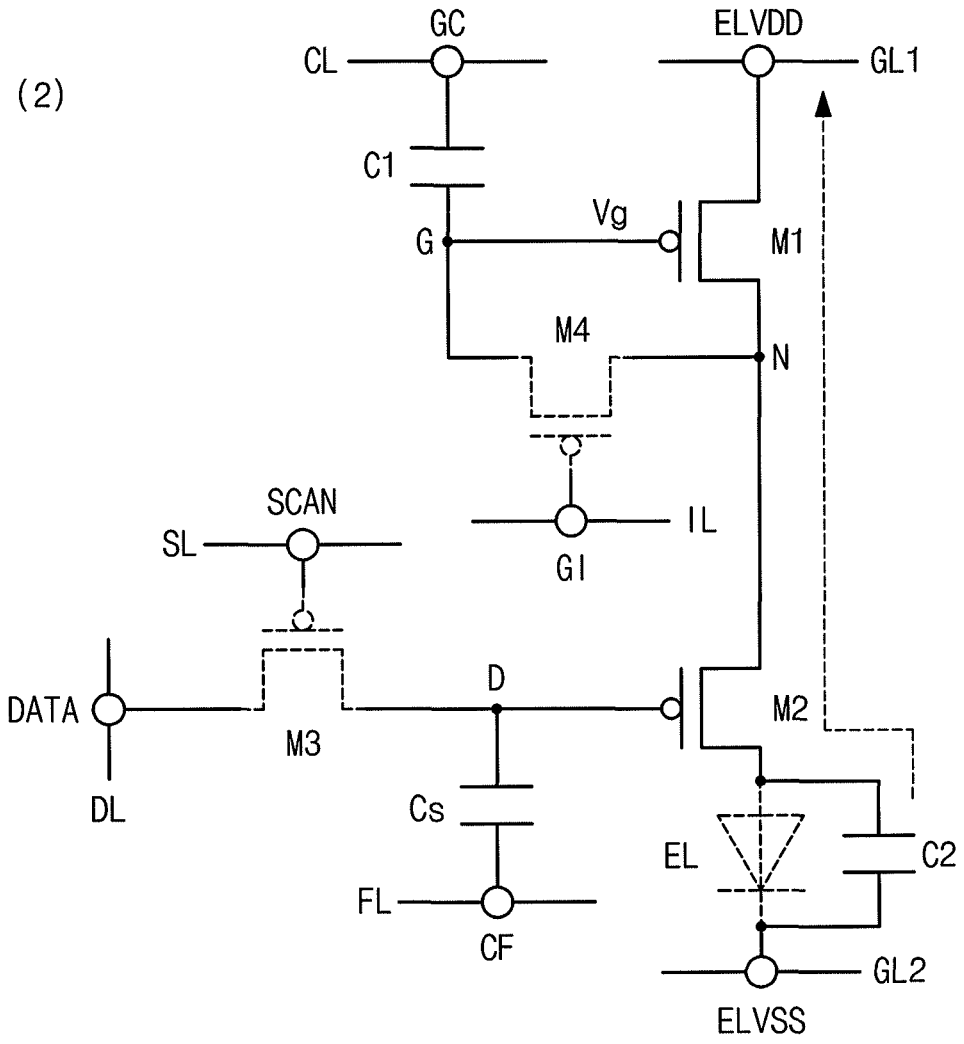
FIG. 7 illustrates a circuit diagram of a driving state of the pixel circuit at a second timing point according to the first exemplary embodiment of the present disclosure.
Figure 8:
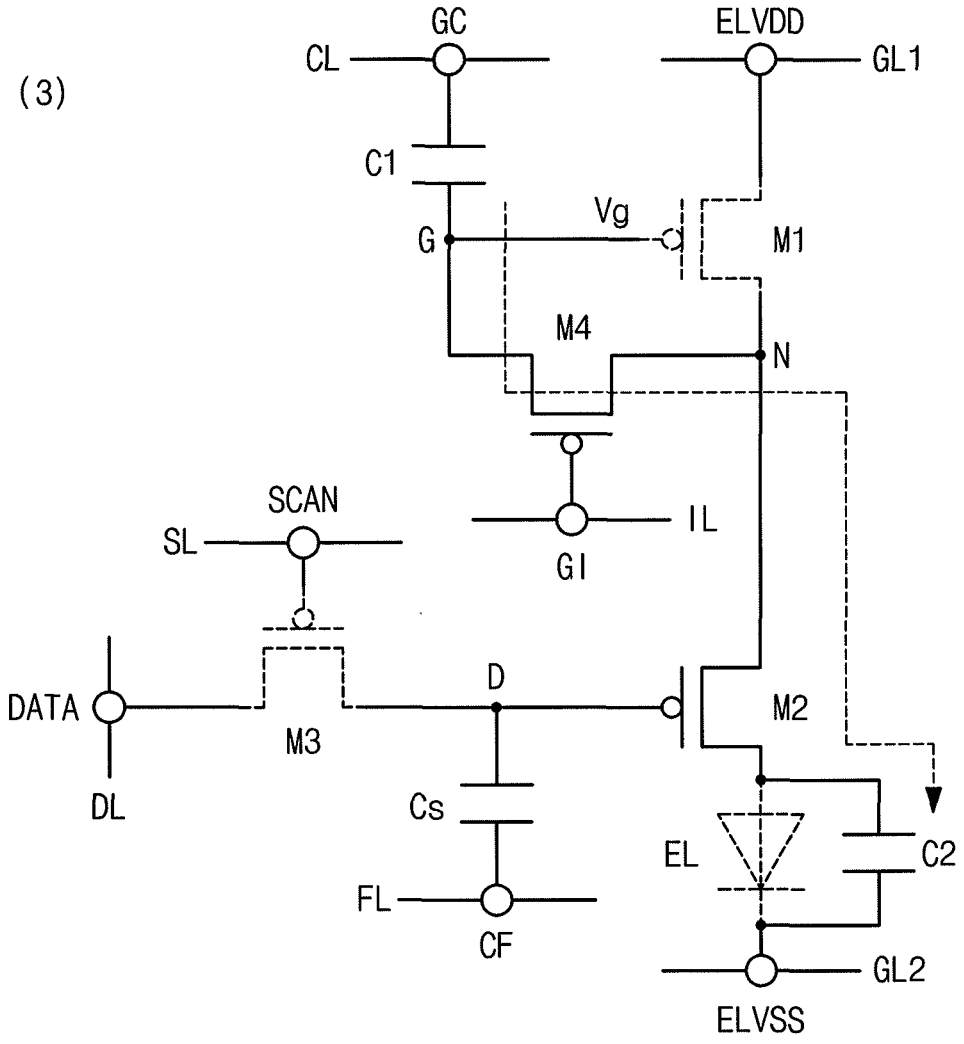
FIG. 8 illustrates a circuit diagram of a driving state of the pixel circuit at a third timing point according to the first exemplary embodiment of the present disclosure.
Figure 9:
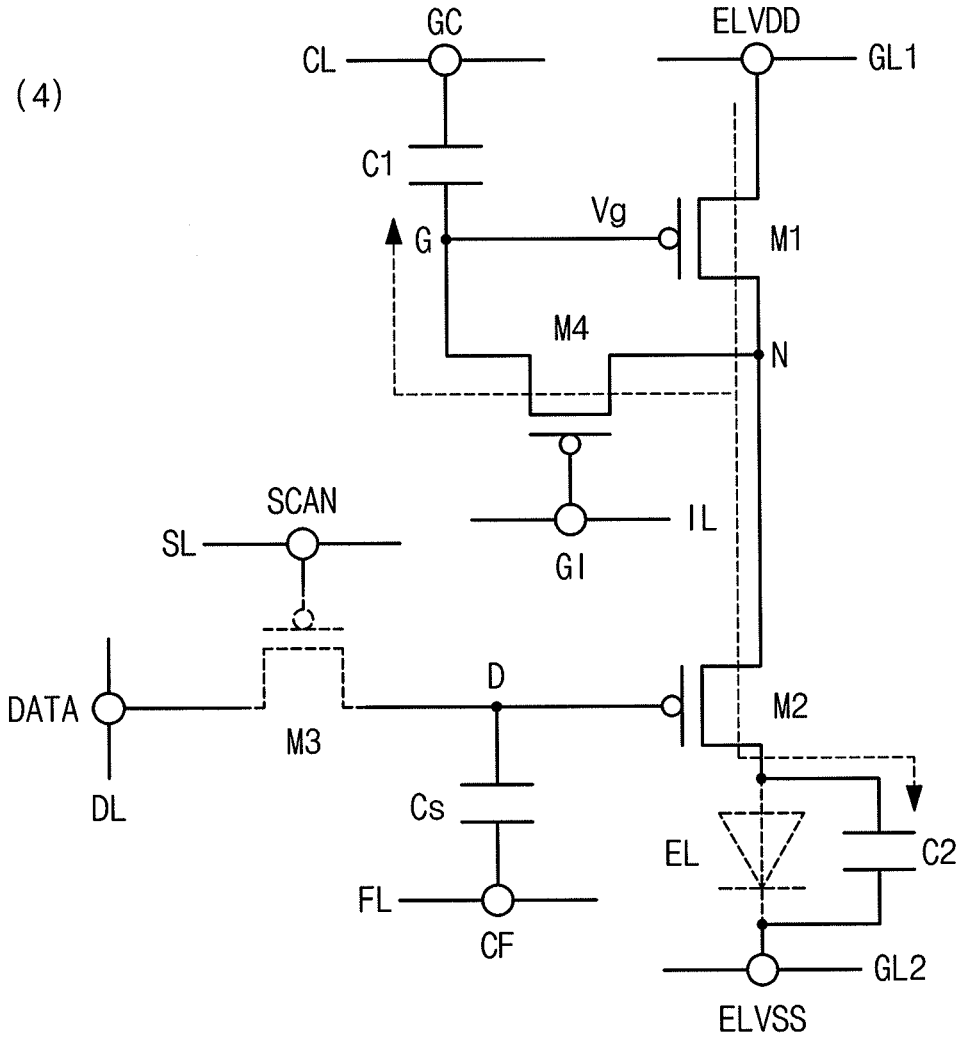
FIG. 9 illustrates a circuit diagram of a driving state of the pixel circuit at a fourth timing point according to the first exemplary embodiment of the present disclosure.
Figure 10:
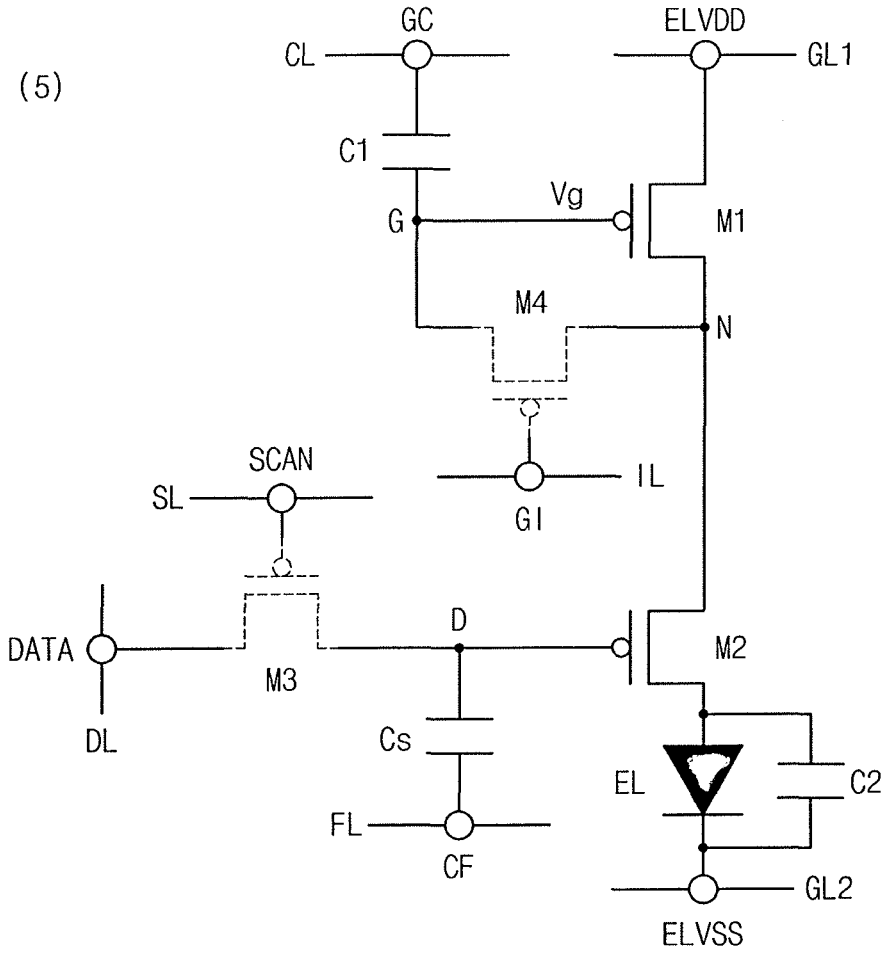
FIG. 10 illustrates a circuit diagram of a driving state of the pixel circuit at a fifth timing point according to the first exemplary embodiment of the present disclosure.

FIG. 6 is a circuit diagram showing a driving state of the pixel circuit at a first timing point (1) according to the first exemplary embodiment of the present disclosure, FIG. 7 is a circuit diagram showing a driving state of the pixel circuit at a second timing point (2) according to the first exemplary embodiment of the present disclosure, FIG. 8 is a circuit diagram showing a driving state of the pixel circuit at a third timing point (3) according to the first exemplary embodiment of the present disclosure, FIG. 9 is a circuit diagram showing a driving state of the pixel circuit at a fourth timing point (4) according to the first exemplary embodiment of the present disclosure, and FIG. 10 is a circuit diagram showing a driving state of the pixel circuit at a fifth timing point (5) according to the first exemplary embodiment of the present disclosure.

At the first timing point (1), the transistor M2 is turned on or off and maintains the state just before the constant current set period SP. In this state, the voltage of the power supply signal ELVSS is changed to the VHs, but the difference in voltage between the power supply signals ELVDD and ELVSS is small. Accordingly, the voltage applied to the light emitting diode EL is lower than the threshold voltage value, and thus the light emitting diode EL does not emit the light. Here, although the transistor M2 is turned on, the light emitting diode EL is represented by a dotted-line as shown in FIG. 6 when the light emitting diode EL is in the light non-emission state in which the current flowing through the light emitting diode EL is not enough to emit the light.

The transistor M1 is turned on because it maintains the state just before the constant current set period SP. In addition, since the transistor M2 maintains the state just before the constant current set period SP, the transistor M2 is turned on or off in accordance with the voltage (data) written in the node D. The transistor M4 is turned off while the gate terminal of the transistor M4 is applied with the VHi. The transistor M3 maintains a turn-off state. In FIG. 6, when the transistors are in the turn-off state, the transistors are represented by the dotted-line.

At the second timing point (2) illustrated in FIG. 7, since the power supply signal ELVDD becomes VLd and has a voltage level lower than that of the power supply signal ELVSS, the light emitting diode EL receives an inverse voltage. Accordingly, current does not flow through the light emitting diode EL, which does not emit light. In addition, the power supply signals ELVDD and ELVSS show a voltage relation such that the light emitting diode EL is in the light non-emission state. Meanwhile, when the control signal GC is lowered to the VLc, the gate voltage Vg is lowered due to the capacitive coupling. Therefore, the transistor M1 maintains the turn-on state even though the power supply signal ELVDD becomes the VLd.

When the control signal CF is lowered to VLf, the voltage of the node D is forcibly lowered by the capacitive coupling of the capacitor Cs and the transistor M2 is controlled to maintain the turn-on state regardless of its original state, e.g., the turn-on state or the turn-off off state. Thus, the electrode of the capacitor C2, which is disposed adjacent to the node N, is connected to the power supply line GL1 and electric charges move, thereby lowering the voltage of the node N. Here, since the voltage of the node D is lowered due to capacitive coupling, the transistor M2 may return to its original state, i.e., the turn-on state or the turn-off state, when the control signal CF returns to VHf.

At the third timing point (3) illustrated in FIG. 8, since the control signal GC increases to VHc and the gate voltage Vg is increased due to the capacitor C1, the transistor M1 is turned off. In addition, the control signal GI is lowered to the VLi and the transistor M4 is turned on. Accordingly, the node G connected to the capacitor C1 is connected to the node N of the capacitor C2 and electric charges move, to thereby lower the gate voltage Vg, i.e., the voltage of node G. In this case, since the voltage of node N is equal to the gate voltage Vg, the transistor M1 maintains the turn-off state. The process that the gate voltage Vg is lowered in the constant current set period SP is generally called an initialization process.

The initialization process is performed using the capacitor C2 of the light emitting diode EL. Therefore, the transistor M2 is required to be turned on at the second and third timing points (2) and (3). Meanwhile, although the transistors M1 and M2 are substantially simultaneously turned on at the second timing point (2), the light emitting diode EL maintains the light non-emission state due to the voltage relation between the power supply signals ELVDD and ELVSS.

At the fourth timing point (4) illustrated in FIG. 9, the power supply signal ELVDD increases to Von and the transistor M1 is turned on. In this case, since the gate voltage Vg is already lowered due to the initialization process, the transistor M1 may be certainly turned on.

Thus, the electrode of the capacitor C1, which is disposed adjacent to the node G, is connected to the power supply line GL 1 and electric charges move. As a result, the gate voltage Vg is increased to the voltage of Von-|Vth|. The "Vth" indicates a threshold voltage value of the transistor M1. At this time, since the power supply signal ELVDD becomes one of the constant current set voltages Von(R), Von(G), and Von(B), the gate voltage Von is changed.

At the fifth timing point (5) illustrated in FIG. 10, since the control signal GI increases to VHi, the transistor M4 is turned off and the gate voltage Vg is set to the voltage in accordance with the threshold voltage value Vth of the transistor M1. The process that the gate voltage Vg is set by the threshold voltage value Vth of the transistor M1 is called a threshold voltage value (Vth) compensation process.

Then, the control signal CF returns to VHf. Accordingly, the transistor M2 returns to the state (the turn-on state or the turn-off state) just before the constant current set period SP. In addition, the power supply signal ELVDD is increased to VHd and the power supply signal ELVSS is decreased to VLs. Therefore, the light emitting diode EL emits the light when the transistor M2 is turned on. As a result, since the light emitting diode EL connected to the pixel circuit 100 in which the transistor M2 maintains the turn-on state starts emitting light, the constant current set period SP is finished. The transistor M1 serves as the constant current source through which the constant current according to the gate voltage Vg flows. In this case, since the gate voltage Vg is set by the Vth compensation process, the same amount of current is provided to the light emitting diodes EL that emit the same color even though a Vth deviation exists between the transistors M1 of the pixel circuits 100.

Then, the node D receives the data signal DATA to maintain the low level voltage or the high level voltage in the pixel circuit 100 selected by the scan signal SCAN, i.e., the pixel circuit 100 receives the scan signal SCAN having the low level voltage, until a next constant current period SP. Accordingly, the transistor M2 may be switched to the turn-on state or the turn-off state and the light emitting diode EL may be turned to the light emission state or the light non-emission state in each sub-frame period, thereby realizing the PWM light emission control.

As described above, when at least four transistors are arranged per one pixel circuit 100 for the PWM light emission control, the difference in light emission intensity of the light emitting diode EL of each pixel circuit 100 is reduced. In addition, since the gate voltage Vg is not set by the capacitive coupling in the present exemplary embodiment, the constant current may be precisely set.

In addition, as shown in FIG. 4, the light emitting diode EL is not needed to be set to the light non-emission state before and after the constant current set period SP applied to all pixels. This is because the data written in the node D remains steady though the constant current set period SP is finished and the light emission of the light emitting diode EL is controlled on the basis of the data right after the constant current set period SP is finished. Accordingly, the constant current set period SP may be set to an arbitrary period within the one frame period. That is, the constant current set period SP may be performed once, more than once, or not at all during the one frame period, and may be performed without being synchronized with the frame. For instance, when the frequency of the constant current set period SP increases, the capacitive in the pixel may be reduced and the high definition of the pixel circuits may be realized.

In the pixel circuit 100 according to the first exemplary embodiment, the constant current circuit 200 is connected to the power supply line GL1 and the switching circuit 300 is connected between the anode of the light emitting diode EL and the constant current circuit 200. In a pixel circuit 100A according to a second exemplary embodiment, the connection relations between components forming the pixel circuit 100A are different from those of the pixel circuit 100 according to the first exemplary embodiment, as described below with reference to FIG. 11.

Figure 11:
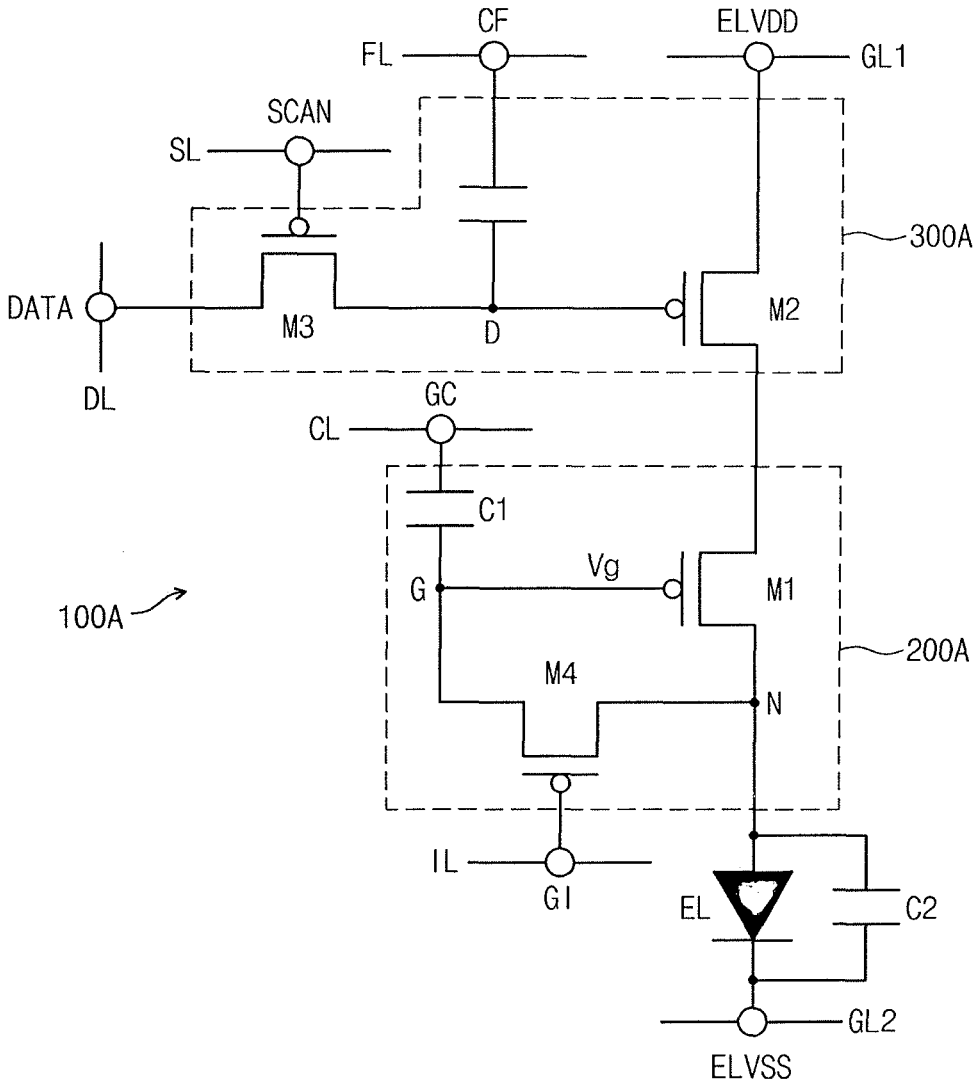
FIG. 11 illustrates a circuit diagram of a pixel circuit according to a second exemplary embodiment of the present disclosure.

FIG. 11 is a circuit diagram showing the pixel circuit 100A according to the second exemplary embodiment of the present disclosure. As illustrated in FIG. 11, the pixel circuit 100A includes a constant current circuit 200A and a switching circuit 300A.

While the constant current circuit 200A has the same configuration as that of the constant current circuit 200 according to the first exemplary embodiment, the connection relations between the transistor M1 and other components are changed. One end of a source and drain electrode of the transistor M1 is connected to a first one of a source and drain electrode of the transistor M2 and a second one of the source and drain electrode of the transistor M1 is connected to the anode of the light emitting diode EL. In the second exemplary embodiment, the node N indicates the point at which the transistor M1 and the light emitting diode EL are connected to each other.

While the switching circuit 300A has the same configuration as that of the switching circuit 300 according to the first exemplary embodiment, the connection relations between the transistor M2 and other components are changed. A first one of a source and drain electrode of the transistor M2 is connected to the power supply line GL 1 and a second one of the source and drain electrode of the transistor M2 is connected to the transistor M1.

The pixel circuit 100A may be driven in accordance with the timing chart shown in FIG. 5. However, in order to realize the operation described in the first exemplary embodiment, values of the high level voltage and the low voltage level of each signal in the second exemplary embodiment are different from those of the first exemplary embodiment. Thus, the same effects may be achieved in the second exemplary embodiment.

In the fourth timing point (4) according to the first exemplary embodiment, the power supply signal ELVDD becomes one of the Von(R), Von(G), and Von(B) according to the light emission color of the light emitting diode EL, and thus the amount of the constant current may be set differently for each light emission color when the PWM light emission control is performed. A method of allowing the amount of the constant current to be different for each light emission color during the PWM light emission control may be a separate method.

In another exemplary embodiment, the power supply signal ELVDD may be set to a uniform voltage Von(C) regardless of the light emission color at the fourth timing point (4) in the first exemplary embodiment. In addition, the power supply signal ELVDD may be changed every light emission color during the PWM light emission control. That is, the VHd of the power supply signal ELVDD, which is set at an initial operation, is required to become the VHd(R), VHd(G), and VHd(B) according to the light emission color. As described above, the VHd-Von is differently set every light emission color.

In the above-mentioned configuration, the p-type transistor is used as the transistors, but the transistor should not be limited to the p-type transistor. That is, an n-type transistor may be used as the transistors or both of the p- and n-type transistors may be used as the transistors. In this case, the n-type transistors or the p- and n-type transistors may not be applied to the pixel circuit 100 or 100A without modifying the pixel circuit 100 or 100A.

By way of summation and review, to reduce the influence on the display image due to the characteristic deviation of the driving transistor, a technique of controlling a threshold voltage (Vth) deviation of a transistor using a constant current circuit that flows a constant current, i.e., a threshold voltage compensation technique, has been developed. However, conventionally, this has required the number of the transistors per pixel to be increased, making high definition display difficult to realize.

Figure 12:
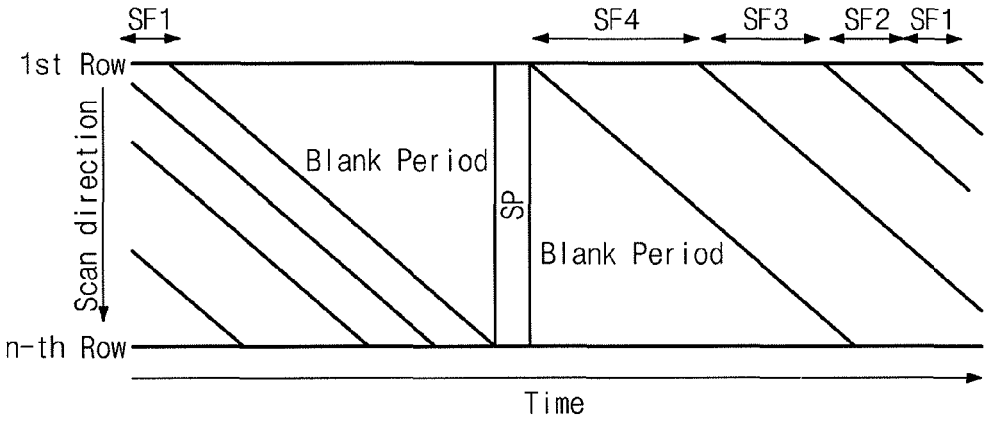
Fig. 12 (RELATED ART)
FIG. 12 illustrates a driving timing of a pixel circuit in each row during a first frame period according to a conventional display device.

FIG. 12 illustrates a driving timing of a pixel circuit in each row during a first frame period according to a conventional display device. As shown in FIG. 12, in order to prevent the time duration of the sub-frame period of each row from being changed before the constant current set period SP performed on all the pixels, the data that prevents the light emitting diode from emitting light is written and maintained until the sub-frame period of the last selected row is finished, even though the sub-frame period of each row is finished. In addition, since the data is required to be rewritten for each pixel after the constant current set period SP is finished, the light emitting diode EL may not emit light until the data is rewritten.

As described above, according to the conventional display device, since there are limitations on setting the constant current set period and a blank period in which the light emitting diode EL is forcibly set to the light non-emission state is set before and after the constant current set period, a light emission duty decreases compared to that of the exemplary embodiments herein.

In other words, in the conventional constant current circuit having the threshold voltage compensation function, the light emitting diode is required to be set in a non-emission state in order to improve a contrast. However, since the current flows from the constant current circuit to the light emitting diode, contrast is lowered. To prevent contrast from being lowered, a separate transistor is added to the constant current circuit to form another current path. Thus, current does not flow to the light emitting diode. In this case, since the number of the transistors increases, the high definition display device is not realized. In addition, the amount of the current flowing through the light emitting diode is difficult to set since the constant current of the constant current circuit is set with capacitive coupling.

In contrast, as described above according to the exemplary embodiments, there are no limitations on the timings of the constant current set period SP and the light emission duty becomes higher. As a result, the display device employing the pixel circuit and a method of driving the same described herein may have increased contrast even though there are fewer transistors in the pixel circuit than that of the conventional display device. Consequently, the display device according to the present disclosure may easily realize the high definition of the display part when compared to the conventional display device.

The present disclosure provides a display device and method of driving the same that reduces the number of transistors per one pixel to realize a high definition image, reduces influence on display images due to a variation in characteristic deviation of the transistors, and improves contrast. In addition, when the constant current circuit according to embodiments sets the constant current with respect to all pixels, the light emission of the light emitting diode may be started again, even though the data is not written again, since the data written in the gate terminal of the second transistor is maintained. As a result, the light non-emission period decreases.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a light emitting diode that emits a light in response to a current supplied thereto; and a pixel circuit including:

a constant current circuit having a first transistor to control an amount of the current supplied to the light emitting diode; and a switching circuit having a second transistor to switch the supply of the current to the light emitting diode and a capacitor having a first terminal connected to a gate terminal of the second transistor and a second terminal connected to a signal line that changes a voltage of the second terminal and disconnected from the second transistor, wherein the first transistor and the second transistor are connected between a first power supply line and an anode of the light emitting diode including a cathode connected to a second power supply line in series.

2. The display device as claimed in claim 1, further comprising:

a driving circuit that drives the pixel circuit such that the light emitting diode emits the light, wherein the driving circuit:

controls voltages of the first and second power supply lines to allow the light emitting diode to be in a light non-emission state, controls the signal line to change a voltage of the gate terminal of the second transistor by using a capacitive coupling of the capacitor and to turn on a current path between the anode of the light emitting diode and the first power supply line, turns on a current path between a gate terminal of the first transistor and the anode after turning off the current path between the anode and the first power supply line, turns on a current path between the gate terminal of the first transistor and the first power supply line to set the gate terminal of the first transistor to have a voltage corresponding to the amount of the supplied current, controls the voltage of the signal line, after the setting the voltage of the gate terminal, to return the voltage of the gate terminal of the second transistor to a voltage before the light emitting diode is switched to the light non-emission state by the capacitance coupling of the capacitor, and drives the pixel circuit to switch the light emitting diode to a light emission state.

3. The display device as claimed in claim 2, wherein the switching circuit further comprises a third transistor connected between a data line and the gate terminal of the second transistor, and the driving circuit is driven to turn the third transistor off during a period in which at least the voltage of the gate terminal of the second transistor is changed by the capacitance coupling.

4. The display device as claimed in claim 3, wherein the pixel circuit includes a plurality of pixel circuits and the driving circuit substantially simultaneously performs the driving on the pixel circuits.

5. The display device as claimed in claim 4, wherein the driving of the driving circuit is performed more than once during one frame period.

6. A driving method of a pixel circuit controlling a light emitting diode that emits a light in response to a current supplied thereto, the pixel circuit including a constant current circuit that includes a first transistor to control an amount of the current supplied to the light emitting diode and a switching circuit including a second transistor to switch the supply of the current to the light emitting diode and a capacitor connected to a gate terminal of the second transistor, the first and second transistors being connected between a first power supply line and an anode of the light emitting diode including a cathode connected to a second power supply line in series, the method comprising:

controlling voltages of the first and second power supply lines to allow the light emitting diode to be in a light non-emission state;

changing a voltage of the gate terminal of the second transistor using a capacitive coupling of the capacitor to turn on a current path between the anode of the light emitting diode and the first power supply line;

turning on a current path between a gate terminal of the first transistor and the anode after turning off the current path between the anode and the first power supply line;

turning on a current path between the gate terminal of the first transistor and the first power supply line to set the gate terminal of the first transistor to have a voltage corresponding to the amount of the supplied current;

returning the voltage of the gate terminal of the second transistor to a voltage before the light emitting diode is switched to the light non-emission state by the capacitance coupling of the capacitor after the setting the voltage of the gate terminal of the first transistor; and driving the pixel circuit to switch the light emitting diode to a light emission state.

7. A pixel circuit that controls a light emitting diode that emits a light in response to a current supplied thereto, the pixel circuit comprising:

a constant current circuit having a first transistor to control an amount of the current supplied to the light emitting diode; and a switching circuit having a second transistor to switch the supply of the current to the light emitting diode and a capacitor having a first terminal connected to a gate terminal of the second transistor and a second terminal connected to a signal line that changes a voltage of the second terminal and disconnected from the second transistor, wherein the first transistor and the second transistor are connected between a first power supply line and an anode of the light emitting diode including a cathode connected to a second power supply line in series.

8. A pixel circuit, comprising:

a first transistor coupled to a power supply line;

a second transistor between the first transistor and a light emitter;

a first capacitor coupled between a gate of the second transistor and a first signal line, wherein the second transistor is to control current from the first transistor to the light emitter based on a data signal and wherein the first transistor is to connect the second transistor to a first voltage of the power supply line in a first period and a second voltage of the power supply line during a second period, the first and second periods included in a constant current set period and the second voltage being a constant current set voltage for a predetermined pixel color.

9. The pixel circuit as claimed in claim 8, wherein:

the constant current set period is a non-emission period, the first signal line has a substantially constant first value during the first period and the second period of the constant current set period, and the first signal line has a second value different from the first value during an emission period.

10. The pixel circuit as claimed in claim 8, further comprising:

a second capacitor, wherein a gate of the first transistor is connected to a second control line through a capacitive coupling with the second capacitor.

11. The pixel circuit as claimed in claim 10, further comprising:

a third transistor coupled between the gate of the first transistor and a terminal of the first transistor, the third transistor including a gate coupled to a third control line.

* * * * *